United States Patent [19]

Köster et al.

[11] 4,354,954

[45] Oct. 19, 1982

[54] METHOD FOR SOLIDIFYING AQUEOUS RADIOACTIVE WASTES FOR NONCONTAMINATING STORAGE

[75] Inventors: Rainer Köster, Karlsruhe; Knut Scheffler, Eggenstein-Leopoldshafen; Ulrich Riege, Linkenheim-Hochstetten, all of Fed. Rep. of Germany

[73] Assignee: Kernforschungszentrum Karlsruhe Gesellschaft mit beschränkter Haftung, Karlsruhe, Fed. Rep. of Germany

[21] Appl. No.: 34,534

[22] Filed: Apr. 30, 1979

[30] Foreign Application Priority Data

Apr. 29, 1978 [DE] Fed. Rep. of Germany ..... 2819085

[51] Int. Cl.[3] ..... G21F 9/08; G21F 9/12; G21F 9/16

[52] U.S. Cl. ..... 252/629; 264/0.5; 264/117; 252/633

[58] Field of Search ..... 252/301.1 W; 264/0.5, 264/117

[56] References Cited

U.S. PATENT DOCUMENTS

| | | | |
|---|---|---|---|
| 2,961,399 | 11/1960 | Alberti | 252/301.1 W |
| 3,249,551 | 5/1966 | Bixby | 252/301.1 W |
| 3,330,771 | 7/1967 | Komatsu et al. | 252/301.1 W |
| 3,673,086 | 6/1972 | Drobnik | 252/301.1 W |
| 4,031,175 | 6/1977 | Cooper | 267/117 |

FOREIGN PATENT DOCUMENTS

| | | |
|---|---|---|
| 2228938 | 1/1974 | Fed. Rep. of Germany . |
| 2000359 | 1/1979 | United Kingdom . |

OTHER PUBLICATIONS

McCarthy, G. S., "High-Level Waste Ceramics", *Nuclear Technology*, vol. 32, (Jan. 1977) pp. 92–105.

*Primary Examiner*—Deborah L. Kyle
*Attorney, Agent, or Firm*—Spencer & Kaye

[57] ABSTRACT

Method for solidifying high and medium radioactivity and/or actinide containing aqueous waste concentrates or fine-grained solid wastes suspended in water for final noncontaminating storage. The waste concentrates or suspensions are set, by evaporation, to a water content in the range between 40 and 80 percent by weight, and a solid content whose metal ion and/or metal oxide component lies between 10 and 30 percent by weight of the evaporate being formed. The pH of the evaporate is set to between 5 and 10. The resulting evaporate is then pelletized with the aid of a clay-like substance. The pellets are then heat treated, including drying at temperatures between room temperature and about 150° C., then calcining at room temperatures up to about 800° C. and subsequently firing at temperatures between 800° C. and 1400° C. to form practically undissolvable mineral phases. The pellets are then enclosed on all sides in a dense, continuous ceramic or metallic matrix.

20 Claims, No Drawings

METHOD FOR SOLIDIFYING AQUEOUS RADIOACTIVE WASTES FOR NONCONTAMINATING STORAGE

BACKGROUND OF THE INVENTION

The present invention relates to a method for solidifying high and medium radioactivity and/or actinide containing aqueous waste concentrates or fine-grained solid wastes suspended in water for final noncontaminating storage in which the waste concentrates or the suspensions are formed into pellets or granules together with absorbing and/or hydraulically binding inorganic material and thereafter subjecting the resulting pellets or granules to a ceramic firing process in order to produce solid sintered bodies.

It has been known for a long time to solidify radioactive aqueous solutions by first reducing the volume of such wastes, thereby concentrating the radioactive substances, and thereafter treating the concentrates either by (1) subjecting them together with glass formers to a heat treatment until the radioactive substances become distributed throughout the resulting glass melt and then having the melt solidify into a solid body, or (2) by mixing the concentrated wastes with silicate-containing clays or with ion exchangers, respectively, and firing the resulting mix ceramically so as to form a solid body.

Some of the drawbacks of producing glass blocks having radioactive waste substances incorporated therein include the need to use relatively complicated and expensive apparatus which must be operated by trained personnel. Moreover, in the course of prolonged storage, decomposition of the glass structure may occur due to the continued emission of radiation and heat energy by the incorporated highly radioactive substances with the result that the resistance of the glass structure to leaching deteriorates with time and its ability to effectively retain radioactive materials is diminished, especially as compared to the relatively good leaching properties of nondecomposed glass waste blocks.

When clay-radionuclide mixtures are fired according to the prior art, the quality of the solidified products containing high concentrations of radioactive substances has not been sufficient for final storage purposes.

An additional problem encountered with prior art solidification by glass and fired clay processes is that during the high temperature stages, significant quantities of radioactive substances evaporate from the not yet solidified waste. These escaping impurities must be trapped and removed by complicated waste gas purification techniques involving solids filters, gas washing columns and condensate separators.

German Pat. No. 1,127,508 to Alberti proposes mixing aqueous atomic waste with fireproof cement and then increasing the density of the resulting hardened block by ceramic firing to produce a sintered body which is resistant to leaching. In order to increase the mechanical stability of the hardened block, the patent suggests adding fireproof additives such as fire clay or brick chips to the fireproof cement. For example, a cylindrical molded body was produced from molten alumina cement and radioactive liquid. The molded body, after hardening, was uniformly heated for a period of 5 hours to a temperature of 500° C. to evaporate excess water. The molded body was then rapidly brought to a firing temperature of, for example, 1100° C. and kept at this temperature for about 2 to 4 hours after which the molded body was cooled slowly. No information is given in the patent about the radioactivity of the radioactive liquid being treated. There is also no disclosure in the patent as to the quantities of liquid being treated in the 3-liter vessels used by Alberti or as to the water-cement values, or the like. Results of leaching experiments likewise were not disclosed.

The Alberti process may be useful for the solidification of low radioactivity aqueous wastes, but it is very expensive and unnecessarily complicated. Further, it cannot be used for the solidification of high or medium radioactivity and/or actinide containing aqueous wastes.

Medium activity waste solutions have been solidified in cement, concrete or bitumen at temperatures of more than about 150° C. Solidification of medium activity waste solutions with cement, concretes or bitumen leads to end products which have low thermal stability and relatively low radiation resistance over extended periods of time. As a result, special safety measures become necessary when depositing these products for intermediate or final storage.

When seeking to store actinide concentrates, the intensive development of radiolysis gases and heat in the product, as a result of the radioactive decomposition of the actinides, renders bitumen, cement or concrete solidification processes completely unsuitable.

Suspended combustion ashes or ion exchangers have previously been solidified in cement and put into barrels which act as sheaths. The thus sheathed, solidified products have then been put directly into storage. The properties of such blocks, however, particularly with respect to mechanical stability and leaching resistance, are not particularly good, so that this type of solidification is used only for weakly active wastes.

In an effort to overcome the aforementioned problems of the prior art, a process for solidifying high and medium radiioactivity and/or actinide containing aqueous waste concentrates or fine-grained solid wastes suspended in water for final noncontaminating storage was disclosed in U.S. patent application Ser. No. 914,152 filed June 9, 1978, assigned to the same assignee as the present application and herein incorporated by reference. According to that application, the waste concentrates or suspensions are initially set, by evaporation, to a water content in the range between 40 and 80 percent by weight, and a solid content whose metal ion and/or metal oxide component lies between 10 and 30 percent by weight of the evaporate or concentrate being formed and a pH between 5 and 10. The evaporate is kneaded with a clay-like substance containing a small quantity of cement or such a clay-like substance or mixture of a clay-like substance with a small quantity of cement containing an additive for suppressing the volatility of the alkalis or alkali earths and/or an additive for suppressing the volatility of any decomposing anions which may be present in the evaporate or concentrate from the group including sulfate, phosphate, molybdate and uranate ions. Molded bodies are produced from the resulting kneaded mass with the aid of molds into which the mass is pressed or with an extrusion press which must be followed by a cutting device. The molded bodies are then heat treated and subsequently fired at high temperatures to form practically undissolvable mineral phases. The molded bodies of fired mineral phases are enclosed on all sides in a dense, continuous ceramic or metallic matrix.

The latter process necessitates the use of so-called hot cells for the solidification of the aqueous wastes due to their radioactivity. In addition, the use of molds or extrusion presses under such conditions is complicated and requires a lot of space. A need therefore exists for a simple and efficient process wherein it is possible to avoid the aforementioned disadvantages wherein the desired pellets can be formed, without difficulty, in an entirely continuous manner.

SUMMARY OF THE INVENTION

It is therefore a primary object of the present invention to provide a method for solidifying high and medium radioactivity aqueous wastes as well as actinide containing aqueous wastes and/or suspended powdery solid wastes, in which the solidification products do not exhibit the drawbacks of the prior art processes and which meet all requirements for final storability.

Consistent with the primary object of this invention is the provision of a simple and efficient method for forming the desired pellets, which method is less susceptable to malfunction and requires only a small amount of space.

It is a further object of the invention to provide a process for preparing radioactive wastes for storage in which the wastes are securely stored and not easily leached.

It is yet another object of the invention to provide a process which is simple and uncomplicated but effective in preventing radioactive contamination.

An additional object of the invention is to provide a process for producing a solidified product which is not troubled by emissions of radiolysis gases.

To achieve the foregoing objects and in accordance with its purposes, the present invention provides a method for solidifying high and medium radioactivity and/or actinide containing aqueous waste concentrates or fine-grained solid wastes suspended in water for final noncontaminating storage in which the waste concentrates or the suspensions are subjected together with absorbing and/or hydraulically binding inorganic material, to a ceramic firing process so as to produce a solid sintered body comprising: (a) setting the waste concentrates or suspensions by evaporation to form an evaporate (B) having a water content in the range between 40 and 80 percent by weight and a solid content whose metal ion and/or metal oxide component lies between 10 and 30 percent by weight of the evaporate (B) being formed, and setting the pH of the evaporate (B) to between 5 and 10; (b) pelletizing the evaporate with a mixture which contains a clay-like substance to form pellets or granules, said mixture further containing cement, or at least one suppressing additive or at least one suppressing additive and cement, the suppressing additive being an additive for suppressing the volatility of the alkalis, especially cesium, or alkali earths, especially strontium, and/or an additive for suppressing the volatility of any decomposing anions which may be present in the evaporate from the group including sulfate, phosphate, molybdate and uranate ions, (c) heat treating the pellets formed in (b) which includes drying at temperatures between room temperature and about 150° C., calcining at temperatures up to about 800° C. and subsequently firing at temperatures between about 800° C. and 1400° C. to practically undissolvable mineral phases; and (d) enclosing the pellets of fired mineral phases on all sides in a dense, continuous ceramic or metallic matrix. The formation of the pellets results from spraying evaporate (B) onto the clay-like substance which is disposed on a moving pelletizing plate. Granulating or pelletizing with the aid of a pelletizing plate is well known in ore processing. However in ore processing, the mineral to be pelletized is contained in the solid matter whereas the waste materials to be solidified, in accordance with this invention, are to be sprayed onto the solid matter.

DETAILED DESCRIPTION OF THE INVENTION

According to the present invention, a liquid which may, for example, be either a suspension or solution of radioactive waste materials is prepared for noncontaminating final storage. The waste materials treated according to the present invention are the by-products of manufacturing, processing and reprocessing of nuclear fuels as well as the wastes of nuclear plants and the like.

The wastes treated in accordance with the present invention may be categorized and defined as follows:

(1) High activity waste solutions—these comprise nitric acid solutions containing predominantly heavy metal nitrates, which are produced during the separation of fission products from spent nuclear fuels.

(2) Medium activity waste solutions—these are predominantly nitric acid solutions, generally containing a large amount of sodium nitrate, which are obtained during the reprocessing of nuclear fuels and during the decontamination processes in nuclear plants.

(3) Actinide concentrates—these are solutions or powders or combustion residues, which are obtained mainly as waste products during the processing and manufacture of nuclear fuels.

(4) Ashes and residues from the combustion of organic radioactive wastes—these ashes and residues are fine-grained solid wastes and are suspended in water.

In the process of the present invention, the waste concentrates or suspensions being treated are first set by evaporation of the waste material to a water content in the range between 40 and 80 percent by weight and a solid content whose metal ion and/or metal oxide component lies between 10 and 30 percent by weight of the evaporate (B) being formed.

The pH of the evaporate is set so that it is between about 5 and 10. The setting may, for example, be made by the addition of highly alkaline solutions, e.g., NaOH or by denitration of nitrate containing wastes, by known means, e.g., by the addition of formic acid or formaldehyde. The setting of the pH of the evaporate can be effected either by treating the waste concentrates or suspensions before the evaporation, or by treating the evaporate. Concentration to produce evaporate (B) by evaporation, which may take place before and/or after adjustment of the pH, can be effected until a barely flowable concentrate is obtained.

The concentrated radioactive evaporates having the desired pH is then sprayed onto a dry mixture of additives, which mixture includes clay-like materials. The term "clay-like materials" or "clay-like substances" as used herein is intended to include clays such as kaolin, bentonite, and montmorillonite, and materials which have similar properties with respect to the process of this invention, such as alumina and/or quartz meal. Thus, the mixture of the additives comprises a clay-like material which can be kaolin, other clays, alumina and- /or quartz meal. In addition, the mixture of additives preferably contains a hydraulically binding material such as cement.

The mixing ratio of substances contained in the radioactive concentrate and the additive mixture should preferably be selected such that the resulting mixture being pelletized has a water content of about 5 to 20 percent by weight and such that shape-retaining bodies can be produced with the evaporate (B). Additionally, the ratio of substances selected should be such that the resulting granules or pellets after drying and sintering, have a chemical composition which corresponds to that of natural, stable minerals or rocks.

The weight ratio of evaporate (B) to the mixture containing the clay-like substance preferably is from 1:6 to 1:2.

The mixture of the additives used with evaporate (B) to form the clay-like granules or pellets may contain 10 to 90 percent by weight cement with respect to the total weight of the clay-like material and the cement. By adding cement to the clay-like material bodies in the form of granules or pellets are obtained which, after complete hardening, maintain their shape, even when treated with water. This advantage is utilized in such a manner that water-soluble salts which have come to the surface of the pellets during the subsequent drying (hardening) process, can be removed by rinsing with water. The wash water can then be returned to the radioactive solution at the start of the process. A further advantage resulting from the addition of cement is the added mechanical and structural stability which it imparts to the pelletized bodies during subsequent processing steps.

In a particularly favorable embodiment of the present invention, a mixture of absorbing clay-like substance and hydraulic binders is used to form the granules or pellets, respectively, with the absorbing, clay-like substance being bentonite and the hydraulic binder being portland cement or other cements in a weight ratio range of bentonite to portland cement between 1:15 and 1:2. The weight ratio of the evaporate to the bentonite—portland cement mixture preferably lies in the range of 3:10 to 5:10.

The clay-like substance advantageously is clay which contains $SiO_2$ in the range from 45 to 70 percent by weight and $Al_2O_3$ in the range from 15 to 40 percent by weight and has a loss due to heating in the range from 5 to 15 percent by weight. The clay-like substance may be one or more species selected from the group of pottery clays, stoneware clays, porcelain clay mixtures and kaolins.

According to another embodiment of the present invention, instead of or together with the addition of cement to the clay-like substance, the mixture of additives which contains the clay-like substance is provided with one or more suppressing additives to suppress or limit the volatility of certain components such as the alkalis and earth alkalis, and/or to suppress the volatility of decomposing anions from the group including sulfate, phosphate, molybdate and uranate. The additive for suppressing the alkalis, especially cesium, and earth alkalis, especially strontium, can comprise 1 to 3 parts by weight $TiO_2$ powder compared to 20 parts per weight of clay-like material, or 1 to 5 weight percent $TiO_2$ with respect to the total composition being pelletized. The additive for suppressing sulfate, molybdate and uranate volatility comprises about 1 to 5 percent by weight BaO while the additive for suppressing phosphate volatility comprises about 2 to 10 percent by weight MgO and BeO or ground, natural mineral beryl $Be_3Al_2$ $(Si_6O_{18})$, each weight percentage being with reference to the total composition being pelletized. A given evaporate or concentrate does not necessarily contain each ion of the group sulfate, phosphate, molybdate and uranate ions, and thus, a suppressing additive need only be provided for those ions present in the evaporate or concentrate which is being pelletized with the mixture which contains the clay-like substances.

Other additives may similarly be incorporated into the mixture which contains the clay-like substances, e.g., cement sealing additives such as barium silicate hydrate.

The mixture which contains the clay-like substances is treated with evaporate (B) by spraying evaporate (B) onto the mixture which is disposed on a moving pelletizing plate. The formation of the desired pellets in accordance with this invention can therefore be achieved in an entirely continuous manner. Thus, the pressing of a doughy mass, as taught in copending application Ser. No. 914,152, filed June 9th, 1978, is eliminated. The range for the size of the pellets is about 1 mm diameter to about 10 mm diameter.

The pelletization in the field of waste-conditioning is unknown until now. The pelletization of for example iron or copper ores is well known. A description of the technique is given in the paper of H. B. Ries "Aufbaugranulierung" (Build-up granulation) from the bulletin "Aufbereitungs-Technnik" 1971, No. 11.

Prior to the heat treatment, the pellets formed on the pelletizing plate are allowed to harden and may be surface decontaminated with water, if desired.

The pellets are advantageously dried and hardened in a stream of air at room temperature which requires a period of time for cement containing products of up to 30 days until they are completely hardened. The completely hardened pellets or granules can then be washed with water to remove water soluble salts from their surfaces. Thereafter, the pellets are subjected to the heat treatment which includes further drying of the pellets in a drying furnace at higher temperatures so that any nitrates contained therein are thermally decomposed. The heating sequence for this heat treatment is largely dependent on the chemical composition of the pellets and their dimensions. Several hours are generally required at temperatures ranging from room temperature to about 150° C. to expel chemically unbound water. At the calcining temperatures ranging from about 150° C. to about 800° C., chemically bound water is expelled and the thermal decomposition of metal nitrates into metal oxides and nitrous gases takes place. The thermal decomposition temperatures of nitrates which are present in higher concentrations must be given particular consideration and it is, therefore, necessary to control the heating rate taking the characteristic decomposition temperatures of each of the nitrates into account. This may necessitate slowing up the heating in a particular temperature range or maintaining it at a given temperature for a period of time until the exhaust air stream contains no significant moisture and no nitrous gases. Thus, the heating is in effect carried out in stages with the heating begin stopped or slowed at the decomposition temperatures of the nitrate compounds present as well as at the temperatures at which the water may be removed. Control and regulation of the heating program is effected simply by continuous quantitative measurement of the amount of condensate collected from the furnace exhaust gases in a condensate separator and by a continuous quantitative measurement of the concentration of nitrous gases in the furnace exhaust gas.

The furnace exhaust gases preferably can be purified in a washing column with dilute nitric acid so as to absorb nitrous gases. These washing solutions, as well as the condensates from the condenser connected upstream of the washing column, are evaporated in an evaporator. The resulting distillates are treated further as weakly active waste solutions and are not part of the process of the present invention. The concentrates from this evaporator can be introduced as waste materials at the start of the process.

After reaching the final temperature of about 800° C. in the drying furnace, the pellets or granules are sintered in a sintering furnace to produce the desired end product. Instead of a separate drying furnace and a separate sintering furnace, drying and sintering can take place in the same furnace. The sintering process is performed at temperatures between about 800° C. and 1400° C., preferably between 1100° C. and 1400° C., to form pellets having practically undissolvable mineral phases and results in significant shrinkage of the pellets. Therefore, in order to prevent the formation of cracks and cavities in the pellets, care must be taken, depending on the size of the pellets, whereby the sintering process be performed at a sufficiently slow rate. The optimum sintering temperature and time must be adapted to the composition of the particular product.

The monolithic sintered pellets are then inserted into metal containers. Because of the heat given off as a result of radioactive decay, the air space between the sintered pellets and the metal vessel or container can be filled by encasing the sintered pellets in a dense continuous matrix having a heat conductivity greater than the bodies themselves, e.g., cement or low melting point metals or alloys such as lead, bronzes and the like. The metal container itself will then be the final storage container for the radioactive wastes that are solidified in the ceramic.

In accordance with one embodiment of the present invention, the sintered pellets are comminuted and the comminuted, sintered pellets are enclosed in the continuous matrix. In this instance, the pellets are preferably comminuted to particles or chips between about 1 mm. and 10 mm. in size.

The continuous matrix completely encloses the molded body or chips and preferably can be made of either cement rock, produced from at least one kind of cement from the group comprising Portland cement, iron Portland cement, blast furnace slag cement, trass cement, oil shale cement, alumina cement and pozzolanic cement types in weight ratios of clay-like material to cement ranging from about 10:1 to 1:10. To further improve heat conductance, the continuous matrix may comprise a copper-zinc alloy, a copper-tin alloy, lead or a lead alloy having a lead content of more than about 50 percent by weight. In cases where the continuous matrix is not made of a metal or an alloy, respectively, ceramic firing, possibly with simultaneous use of pressure, terminates the densification of the matrix waste mixture.

The invention will now be explained by way of the example which follows without, however, being limited to this example.

EXAMPLE

With the aid of a laboratory size pelletizing device whose pelletizing plate has a diameter of 40 cm and is inclined at an angle of 46°, granular products or pellets, having a diameter of about 1 cm, respectively, were produced at a speed of rotation of 26 rpm from one kilogram of Portland cement containing about 10% by weight bentonite and 230 gms of a medium radioactive category simulation solution of the following composition:

| | | |
|---|---|---|
| $NaNO_3$ | 450.0 | g/l |
| $NaNO_2$ | 5.0 | g/l |
| $Fe(NO_3)_3$ | 0.1 | g/l |
| $Ni(NO_3)_2$ | 0.01 | g/l |
| $Cr(NO_3)_3$ | 0.01 | g/l |
| $Ca(NO_3)_2$ | 0.15 | g/l |
| $Mn(NO_3)_2$ | 0.02 | g/l |
| $Sr(NO_3)_2$ | 0.002 | g/l |
| $Mg(NO_3)_2$ | 0.2 | g/l |
| $Ce(NO_3)_4$ | 0.02 | g/l |
| $Al(NO_3)_3$ | 0.03 | g/l |
| Tributylphosphate | 0.2 | g/l |
| Dibutylphosphate | 0.1 | g/l |
| Kerosene | 0.02 | g/l |
| Sodiumoxalate | 10.0 | g/l |
| Sodiumtartrate | 10.0 | g/l |
| NaF | 2.0 | g/l |
| Detergents | 2.0 | g/l |
| Cs | 0.004 | g/l |
| P in the form of $NaH_2PO_4$ | 0.2 | g/l |

The solution was started with $HNO_3$ (1 m). Before solidification, a pH of 8.5–9 was set with NaOH. The granules or pellets resulting from this Example could then be processed further in accordance with this invention.

The amount of waste solution to be solidified in accordance with this invention can be set by selecting the diameter of the pelletizing plate that is used.

It will be understood that the above description of the present invention is susceptible to various modifications, changes and adaptations, and the same are intended to be comprehended within the meaning and range of equivalents of the appended claims.

We claim:

1. Method for solidifying high radioactivity aqueous waste concentrates, medium radioactivity aqueous wastes concentrates, actinide containing aqueous waste concentrates, or suspensions of fine-grained solid wastes suspended in water, which concentrates or suspensions contain a metal ion and/or metal oxide, for final non-contaminating storage in which the waste concentrates or the suspensions are subjected, together with an absorbing and/or hydraulically binding inorganic material, to a ceramic firing process so as to produce a solid sintered body comprising the steps of:

(a) treating the waste concentrates or suspensions by evaporation, to form an evaporate having a water content in the range between 40 and 80 percent by weight and a solid content whose metal ion and/or metal oxide concentration lies between 10 and 30 percent by weight of the evaporate being formed, and adjusting the pH of the evaporate to between 5 and 10;

(b) pelletizing by spraying 1 part by weight of the evaporate obtained from step (a) onto 2 to 6 parts by weight of a mixture containing a clay-like substance disposed on a moving pelletizing plate, to form pellets said mixture further containing (1) 10% to 90% cement based on the total weight of the clay-like substance and cement, or (2) an effective amount of at least one suppressing additive, or (3) mixtures thereof, the suppressing additive being an additive for suppressing the volatility of alkali metals or alkaline earth metals and/or an additive for suppressing the volatility of any decomposable anions selected from the group consisting of sulfate, phosphate, molybdate and uranate ions which may be present in the evaporate, (c) heat treating said pellets including drying at temperatures between room temperature and 150° C., calcining at temperatures up to 800° C., and subsequently firing at temperatures between 800° C. and 1400° C. to form practically undissolvable mineral phases; and (d) enclosing said pellets containing the fired mineral phases on all sides in a dense, continuous ceramic or metallic matrix.

2. The method as defined in claim 1, in which the pellets are comminuted to a grain size range of about 1 to 10 mm before being enclosed in the matrix of step (d).

3. The method as defined in claim 1 wherein said clay-like substance contains from about 45 to 70 percent by weight $SiO_2$ and from about 15 to 40 percent by weight $Al_2O_3$ and has a loss due to heating which lies in the range from about 5 to 15 percent by weight.

4. The method as defined in claim 1 wherein the clay-like substance is at least one substance selected from the group consisting of pottery clays, stoneware clays, procelain clay mixtures and kaolins.

5. The method as defined in claim 1 wherein the additive for suppressing the volatility of the alkali metals and alkaline earth metals comprises from 1 to 3 parts by weight $TiO_2$ powder compared to 20 parts by weight clay-like substance.

6. The method as defined in claim 1 wherein the additive for suppressing the volatility of the alkali metals or alkaline earth metals comprises about 1 to 5 weight percent $TiO_2$ with respect to the total weight of the evaporate and mixture containing the clay-like substance which is being pelletized in step (b).

7. The method as defined in claim 1 wherein the additive for suppressing the volatility of sulfate, molybdate and/or uranate comprises from 1 to 5 weight percent BaO with respect to the total weight of the evaporate and mixture containing the clay-like substance which is being pelletized in step (b).

8. The method as defined in claim 1 wherein the additive for suppressing the volatility of phosphate comprises from about 2 to 10 weight percent MgO with respect to the total weight of the evaporate and mixture containing the clay-like substance which is being pelletized in step (b).

9. The method as defined in claim 1 wherein the additive for suppressing the volatility of phosphate comprises from about 2 to 10 weight percent BeO or ground natural mineral beryl $Be_3Al_2(Si_6O_{18})$ with respect to the total weight of the evaporate and mixture containing the clay-like substance which is being pelletized in step (b).

10. The method as defined in claim 1 wherein the continuous matrix comprises at least one cement selected from the group consisting of Portland cement, iron Portland cement, blast furnace slag cement, trass cement, oil shale cement, alumina cement, pozzolanic cement types and mixtures thereof.

11. The method as defined in claim 1 wherein the continuous matrix comprises a fired ceramic produced from (1) at least one clay-like substance selected from the group consisting of pottery clays, stoneware clays, porcelain clay mixtures, and kaolin and (2) at least one cement selected from the group consisting of Portland cement, iron Portland cement, blast furnace slag cement, trass cement, oil shale cement, and alumina cement, and pozzolanic cement types in a weight ratio range of clay-like substance to cement of 10:1 to 1:10.

12. The method as defined in claim 1 wherein the continuous matrix is a copper-zinc alloy.

13. The method as defined in claim 1 wherein the continuous matrix is a copper-tin alloy.

14. The method as defined in claim 1 wherein the continuous matrix is lead or a lead alloy having a lead content of more than 50 percent by weight.

15. The method as defined in claim 1 wherein the adjusting of the pH is effected by the addition of a strongly alkali solution.

16. The method as defined in claim 1 which comprises adjusting the pH of said evaporate by denitrating.

17. The method as defined in claim 16 wherein the denitrating is effected with formaldehyde.

18. The method as defined in claim 1 which comprises adjusting the pH of the evaporate by denitrating with formic acid.

19. The method as defined in claim 1 which further comprises measuring the water and $NO_x$ content of gases given off during the drying and calcining stages of step (c) and varying the time and temperature of the drying and calcining stages as a function of the measured water and $NO_x$ content.

20. The method as defined in claim 1 wherein the pelletizing is a build-up granulation.

* * * * *